United States Patent [19]

Giannetti et al.

[11] 4,190,518

[45] Feb. 26, 1980

[54] SOLVENT REFINED COAL PROCESS

[75] Inventors: Joseph P. Giannetti, Allison Park; Harold E. Swift, Gibsonia, both of Pa.

[73] Assignee: Gulf Research and Development Company, Pittsburgh, Pa.

[21] Appl. No.: 865,605

[22] Filed: Dec. 29, 1977

[51] Int. Cl.[2] ..... C10G 1/00; C10G 1/06

[52] U.S. Cl. ..... 208/8 LE; 208/10

[58] Field of Search ..... 208/8, 10

[56] References Cited

U.S. PATENT DOCUMENTS

| | | | |
|---|---|---|---|
| 3,184,401 | 5/1965 | Gorin | 208/8 |
| 3,575,847 | 4/1971 | Sprow et al. | 208/10 |
| 3,884,796 | 5/1975 | Hinderliter et al. | 208/8 |
| 4,018,663 | 4/1977 | Karr, Jr. | 208/10 |
| 4,083,769 | 4/1978 | Hildebrand et al. | 208/10 |

*Primary Examiner*—Delbert E. Gantz

*Assistant Examiner*—William G. Wright

[57] ABSTRACT

A slurry composed of coal and a solvent containing donatable hydrogen, together with hydrogen, is subjected to catalyst-free hydrogenation conditions in a first hydrogenation zone to form an intermediate coal-solvent slurry. After removing ash from the intermediate coal-solvent slurry to form a coal-solvent solution, the coal-solvent solution is subjected to catalytic hydrogenation conditions in a second hydrogenation zone to obtain a product that can be separated at ambient pressure into (a) a first liquid fraction boiling at a temperature in the range of about 100° to about 375° C., (b) a second liquid fraction boiling above said first liquid fraction at a temperature in the range of about 200° to about 525° C. and (c) a solid and/or semi-solid material. Following the separation, at least a portion of the second liquid fraction is recycled to the first hydrogenation zone.

12 Claims, 2 Drawing Figures

SOLVENT REFINED COAL PROCESS

BACKGROUND OF THE INVENTION

1. Field of the Invention

A need exists to develop a process for producing an upgraded solid material which is solid and/or semi-solid at room temperature from coal and which is capable of later being combined with a liquid for further uses, such as, for example, as fuel. Since coal reserves represent one of the largest sources of energy supply in the world, much attention has been directed to devising and developing processes for conversion and/or upgrading coal. The term "conversion", as employed herein, includes processes wherein a solid carbonaceous material, essentially hydrocarbon in nature, such as, for example, coal, as defined herein, is changed, in accordance with the process defined and claimed herein, physically and/or chemically, to another distinct specie, such as, for example, the change that occurs as a result of the hydrogenation of coal to a liquid. The term "upgrading" includes processes wherein treatment of the solid carbonaceous material, for example, coal, results in a product having enhanced physical and/or chemical properties, such as, for example, where some of the solid carbonaceous material is not liquified during processing but has a lower ash content and is lower in sulfur and nitrogen and/or where the liquid or solid obtained is lower in sulfur and nitrogen content. Attempts to provide an effective process for upgrading coal have not been generally successful because of the difficulty of incorporation, cost and amount of hydrogen required to convert coal to an upgraded material. Further, when coal, whether ash-containing or deashed, is treated with a catalyst, the result is rapid catalyst aging and a decrease in activity because of excessive coking and/or plugging. Additionally, where a solid and/or semi-solid material at room temperature can be obtained, such product cannot later be readily combined with a liquid for further use, i.e., it is usually burned as solid fuel.

The present invention overcomes these problems by providing a process for upgrading coal which comprises the step of: (1) subjecting a slurry composed of coal and a solvent containing donatable hydrogen, together with hydrogen, to catalyst-free hydrogenation conditions in a first hydrogenation zone to form an intermediate coal-solvent slurry; (2) deashing said intermediate coal-solvent slurry to form a coal solvent solution; (3) subjecting said coal-solvent solution to catalytic hydrogenation conditions in a second hydrogenation zone to obtain a product that can be separated at ambient pressure into (a) a first liquid fraction boiling at a temperature in the range of about 100 to about 375° C., (b) a second liquid fraction boiling above said first liquid fraction at a temperature in the range of about 200° to about 525° C. and (c) a solid and/or semi-solid material; and then (4) recycling at least a portion of said second liquid fraction to said first hydrogenation zone.

2. Description of the Prior Art

U.S. Pat. No. 3,932,266 to Sze et al discloses a method of effecting hydrogen addition to coal in two stages, with ash being separated between stages, to produce a synthetic crude. The synthetic crude is produced from coal by initially hydrogenating coal in the presence of a solvent and a hydrolique-faction catalyst. The liquid product containing insoluble material from the initial hydrogenation is then deashed using a "liquid promoter", and the essentially ash-free liquid coal product is then subjected to a second hydrogenation in the presence of a catalyst wherein sufficient hydrogen is added to provide a synthetic crude (column 1, lines 28 to 58; column 10, lines 24 to 31; and claim 1). In marked contrast to the present invention, the Sze process consumes greater quantities of hydrogen, does not provide a solvent containing donatable hydrogen for use in the initial hydrogenation and results in rapid catalyst aging in the first hydrogenation.

SUMMARY OF THE INVENTION

We have discovered a unique process for upgrading coal which comprises the steps of: (1) subjecting a slurry composed of coal and a solvent containing donatable hydrogen, together with hydrogen, to catalyst-free hydrogenation conditions in a first hydrogenation zone to form an intermediate coal-solvent slurry; (2) deashing said intermediate coal-solvent slurry to form a coal-solvent solution; (3) subjecting said coal-solvent solution to catalytic hydrogenation conditions in a second hydrogenation zone to obtain a product that can be separated at ambient pressure into (a) a first liquid fraction boiling at a temperature in the range of about 100° to about 375° C., (b) a second liquid fraction boiling above said first liquid fraction at a temperature in the range of about 200° to about 525° C. and (c) a solid and/or semi-solid material and then (4) recycling at least a portion of said second fraction to said first hydrogenation zone.

The coal that can be used herein can have the following composition on a moisture-free basis:

Table 1

| | Composition of Coal | |
|---|---|---|
| | Broad Range, Wt. % | Preferred Range, Wt. % |
| Carbon | 45–94 | 60.5–92 |
| Hydrogen | 2.5–7.0 | 4.0–6.0 |
| Oxygen | 2.0–45 | 3.0–25 |
| Nitrogen | 0.25–2.5 | 0.75–2.5 |
| Sulfur | 0.3–10 | 0.5–6.0 |

The carbon and hydrogen content of the coal will reside primarily in benzene compounds, multi-ring aromatic compounds, heterocyclic compounds, etc. Oxygen and nitrogen are believed to be present primarily in chemical combination with the aromatic compounds. Some of the sulfur is believed to be present in chemical combination with the aromatic compounds and some in chemical combination with inorganic elements associated therewith, for example, iron and calcium.

In addition to the above, coal being treated herein will also contain solid, primarily inorganic, compounds which will not be convertible to product herein, which are termed as "ash", and are composed chiefly of compounds of silicon, aluminum, iron and calcium, with smaller amounts of compounds of magnesium, titanium, sodium and potassium. The ash content of the coal treated herein amounts to less than 50 weight percent, based on the weight of moisture-free coal, but, in general, amounts to about 0.1 to about 30 weight percent, preferably about 0.5 to about 20 weight percent.

Anthracitic, bituminous and subbituminous coal, lignitic materials and other types of coal materials referred to in ASTM D-388 are exemplary of the coal which can be treated in accordance with the process of the present invention to produce upgraded products therefrom. The coal, prior to the use in the process of the invention, is preferably ground in a suitable attrition machine, such as a hammermill, to a size such that at least 50 percent of the coal will pass through a 40-mesh (U.S. series) sieve. The ground coal is then dissolved and/or slurried in a suitable solvent.

Any liquid compound, or mixtures of such compounds, containing donatable hydrogen can be used as a solvent herein. However, liquid aromatic hydrocarbons are preferred. By "donatable hydrogen" it is meant that a compound can, under the conditions of reaction herein, add hydrogen and also release the same. A solvent found particularly useful as a start-up solvent is anthracene oil defined in *Chamber's Technical Dictionary,* MacMillan (Great Britain, 1943), p. 40 as follows: "A coal-tar fraction boiling above 518° F., consisting of anthracene, phenanthrene, chrysene, carbozole and other hydrocarbon oils." Other solvents which can be satisfactorily employed as start-up solvents herein are those which are commonly used in the Pott-Broche process. Examples of these are polynuclear aromatic hydrocarbons such as naphthalene and chrysene and their hydrogenated products such as tetralin (tetrahydronaphthalene), decalin, etc. or one or more of the foregoing in admixture with a phenolic compound such as phenol or cresol.

The selection of a specific solvent when the process of the present invention is initiated is not critical since a liquid fraction which is obtained on completion of the defined conversion process will serve as a solvent for the process at equilibrium conditions. The liquid fraction which is employed and formed during the process as described herein is referred to as a "second liquid fraction" and is produced in a quantity which can be more than sufficient to replace any solvent that is converted to other products or which is lost during the process. Thus, a second liquid fraction formed in the process of the invention is advantageously recycled to the first hydrogenation zone of the process. In a preferred embodiment, the operation can be carried out that all of the "second liquid fraction" produced is recycled and satisfies the requirements of the solvent needed in the first hydrogenation zone. It will be recognized that as the process continues the solvent used initially becomes increasingly diluted with the second liquid fraction until the solvent used initially is no longer distinguishable from the second liquid fraction. If the process is operated on a semi-continuous basis, the solvent which is employed at the beginning of each new period will be that which has been obtained from a previous operation.

A slurry composed of coal and a solvent containing donatable hydrogen, together with hydrogen, is subjected to catalyst-free hydrogenation conditions in a first hydrogenation zone. The catalyst-free hydrogenation conditions are set forth in Table 2.

Table 2

Catalyst-Free Hydrogenation Conditions

| | Broad Range | Preferred Range |
|---|---|---|
| Temperature, °C. | 343–510 | 399–482 |
| Pressure, kPa (psig)[1] | 3,447–34,470 (500–5,000) | 6,894–13,888 (1,000–2,000) |
| Solvent/Coal Weight Ratio | 0.5/1–10/1 | 1/1–4/1 |
| Hydrogen/Coal Feed Weight Ratio | 0.01/1–0.30/1 | 0.05/1–0.10/1 |
| Hydrogen Gas Purity, mole % | 85–100 | 95–97 |

Table 2-continued

Catalyst-Free Hydrogenation Conditions

| | Broad Range | Preferred Range |
|---|---|---|
| Residence Time, hrs | 0.1 to 5.0 | 0.5 to 2.0 |

[1]kilopascals (pounds per square inch gauge)

By "catalyst-free" it is meant that no external catalyst is added to the first hydrogenation zone; however, ash in the coal itself is present and is known to have some catalytic properties. The exact conditions selected depend, for example, upon the particular feed to be treated, the degree of hydrogenation desired, etc. It is economically desirable to use as low a temperature as possible and still obtain the desired results. If desired, unreacted hydrogen can be recovered and recycled.

After subjecting the slurry to catalyst-free hydrogenation conditions, an intermediate coal-solvent slurry having the typical analysis set forth in Table 3 is obtained.

Table 3

Intermediate Coal-Solvent Slurry Analysis

| | Broad Range | Preferred Range |
|---|---|---|
| Specific gravity at 15.6° C. | 1.0–1.25 | 1.1–1.2 |
| Kinomatic viscosity at 98.9° C. | 20–30 | 22–26 |
| Density at 15.6° C. | 1.0–1.3 | 1.1–1.2 |
| Ash | 2.0–8.0 | 4.0–5.0 |
| Pyridine insolubles | 5.0–8.0 | 6.0–7.0 |

Distillation, ASTM D-1160

| Percent | | |
|---|---|---|
| Broad Range | Preferred Range | Temperature, °C. at 1 atm |
| 2.0– 7.0 | 4.5– 5.5 | 270 |
| 7.0–15.0 | 9.5–10.5 | 285 |
| 15.0–25.0 | 19.5–20.5 | 297 |
| 25.0–35.0 | 29.5–30.5 | 317 |
| 35.0–45.0 | 39.5–40.5 | 341 |
| 45.0–55.0 | 49.5–50.5 | 368 |
| 55.0–65.0 | 59.5–60.5 | 409 |
| 65.0–75.0 | 69.5–70.5 | 487 |
| | | recovery of all distillables occurs at about 400 to about 550° C., preferably at about 450 to about 510° C. |

The hydrogenation effected at this point is not sufficient to have converted the coal to a liquid in the absence of the solvent, that is, if the solvent were separated from the product at the end of the catalyst-free hydrogenation at ambient temperature and ambient pressure, left behind would be a mixture of deashed coal and ash.

Ash and/or other insoluble material can be separated from the intermediate coal-solvent slurry by any technique known to one of ordinary skill in the art to provide a coal-solvent solution, as defined herein, to be essentially free of insoluble material and/or ash. Suitable techniques for ash removal, deashing, can include, for example, filtration, filter wash solvent, separation, and centrifugation. The preferred technique for deashing in the present invention is filtration. The coal-solvent solution formed as a result of deashing has essentially the same analysis as the intermediate coal-solvent slurry in Table 3, except the ash has been removed. In one embodiment of the present invention some or all of the ash from the deashing step is recycled to the first hydrogenation zone to enhance hydrogen take-up.

A coal-solvent solution formed as a result of deashing is subjected to catalytic hydrogenation conditions in a second hydrogenation zone. The catalytic hydrogenation conditions are set forth in Table 4.

Table 4

| Catalytic Hydrogenation Conditions | Broad Range | Preferred Range |
|---|---|---|
| Temperature, °C. | 260–538 | 399–454 |
| Pressure, kPa (psig) | 3,447–68,940 (500–10,000) | 6,894–27,576 (1,000–4,000) |
| Liquid Hourly Space Velocity, volume feed/volume catalyst/hr | 0.3–10 | 1.0–4 |
| Hydrogen Flow Rate, kmol $H_2/m^3$ feed | 25–190 | 60–90 |

Any hydrogenation catalyst suitable for use in coal hydrogenation can be used herein, for example, the catalyst defined and claimed in U.S. Pat. No. 3,840,473. The preferred catalyst is comprised of a hydrogenation component selected from the group consisting of Group VI and Group VIII metals, their oxides and sulfides, supported on a non-zeolitic carrier, which catalyst is promoted with a Group IV-B metal.

The hydrogenation component employed in the catalyst can be one of a combination of the Group VI and Group VIII metals or their oxides or sulfides. We prefer to employ catalysts containing a combination of Group VI and Group VIII components, and particularly we prefer to employ such components in an atomic ratio of Group VIII metal to Group VI metal of at least 1:0.3, preferably at least about 1:0.5, and more preferably at least about 1:1.0. Generally, we do not employ such catalyst with a Group VIII to Group VI atomic ratio in excess of about 1:5, preferably an atomic ratio of less than about 1:3.5, and more preferably an atomic ratio of less than about 1:2.5. We find a particularly preferred catalyst contains the Group VIII and Group VI metals in an atomic ratio of less than about 1:1.75. Further, the catalysts have a total Group VI plus Group VIII metals content of at least about 5 percent by weight based upon the total catalyst, and preferably at least about 10 percent by weight. As a general rule, we do not employ catalysts containing more than about 50 percent by weight metals and usually restrict total Group VI and Group VIII metal content to less than about 30 percent by weight. Preferred catalysts for use in our process can be comprised of combinations of the iron group metals and Group VI metals such as molybdenum and tungsten. Of the iron group metals we prefer to employ cobalt and nickel, with nickel being particularly preferred, and of the Group VI metals we prefer to employ molybdenum. Illustrative of particularly preferred catalysts for use in our invention have metal combinations of nickel-molybdenum, cobalt-molybdenum, nickel-tungsten, and nickel-cobalt-molybdenum.

The most preferred catalyst employed contains a Group IV-B metal, i.e., titanium, zirconium, or hafnium. Accordingly, we employ catalysts containing at least 1 percent by weight of a Group IV-B metal based upon the total catalyst and preferably containing at least about 2.5 percent by weight. While there does not appear to be any upper limit on maximum amount of Group IV-B metal which can be employed, there does not appear to be any advantage to employing more than about 10 percent by weight based upon the total catalyst of such metal. Preferably, we employ catalysts containing less than about 8 percent by weight of a Group IV-B metal. Of the Group IV-B metals (titanium, zirconium and hafnium), we prefer to employ titanium and zirconium, with titanium being particularly preferred.

The carrier or support employed in the catalyst can be any non-zeolitic refractory oxide having a surface area in excess of 5 $m^2/g$, such as alumina, silica aluminas, silica gels, acid-leached boro-silicate glass and spinels, e.g., magnesium aluminate, magnesium oxide, alumina-aluminum phosphates, etc. Preferably, however, we employ an alumina carrier.

The catalyst can be a variety of shapes and sizes, such as 1/32-inch extrudates, ¼-inch tablets or ½-inch stars or rings. This is not part of the invention and whatever shape or size is most suitable for a given operation can be employed.

When treating a coal-solvent solution, according to the process of the invention, it is customary to continue the reaction until the catalyst activity has decreased markedly due to the deposition of ash and/or coke or other carbonaceous material thereon. In the process of the present invention, the reaction will continue over an extended period of time before regeneration of the catalyst is required. When regeneration of the catalyst becomes necessary, the catalyst can be regenerated by combustion, i.e., by contact with an oxygen-containing gas such as air at an elevated temperature usually about 482° C. or by any other means generally used to regenerate hydrogenation catalysts. The manner in which the catalyst is regenerated does not constitute a portion of the present invention.

Catalytic hydrogenation produces a product that can be separated by any conventional method known in the art, especially by distillation at ambient pressure into (a) a first liquid fraction boiling at a temperature in the range of about 100 to about 375° C., preferably about 150° to about 325° C., (b) a second liquid fraction boiling above said first liquid fraction at a temperature in the range of about 200° to about 525° C., preferably about 250° to about 475° C. and (c) a solid and/or semi-solid material.

An analysis of the first liquid fraction is set forth in Table 5.

Table 5

| Analysis of the First Liquid Fraction | Broad Range, wt % | Preferred Range, wt % |
|---|---|---|
| Carbon | 87.0–93.0 | 88.0–91.0 |
| Hydrogen | 7.0–12.0 | 8.5–11.0 |
| Nitrogen | 0.0– 2.0 | 0.1– 0.7 |
| Oxygen | 0.0– 2.0 | 0.1– 0.7 |
| Sulfur | 0.0– 0.5 | 0.0– 0.3 |

If desired, the first liquid fraction can be recycled for use in the deashing stage.

An analysis of the second liquid fraction is set forth in Table 6.

Table 6

| Analysis of the Second Liquid Fraction | Broad Range, wt % | Preferred Range, wt % |
|---|---|---|
| Carbon | 87.0–93.0 | 89.0–92.5 |
| Hydrogen | 6.5–10.5 | 7.5– 9.5 |
| Nitrogen | 0.0– 2.0 | 0.1– 0.7 |
| Oxygen | 0.0– 2.0 | 0.1– 0.7 |
| Sulfur | 0.0– 0.5 | 0.0– 0.3 |

An analysis of the solid and/or semi-solid material is set forth in Table 7.

Table 7

| Analysis of the Solid and/or Semi-Solid Material | Broad Range, wt % | Preferred Range, wt % |
|---|---|---|
| Carbon | 87.0–93.0 | 88.0–92.0 |
| Hydrogen | 5.5– 9.5 | 6.5– 8.0 |
| Nitrogen | 0.3– 3.0 | 0.8– 2.0 |
| Oxygen | 0.0– 1.5 | 0.1– 1.0 |
| Sulfur | 0.0– 0.5 | 0.0– 0.2 |

The solid and/or semi-solid material is capable of being blended and/or cut for pumpability or to obtain a desired fuel composition. For example, the solid material can be burned as an essentially ash-free coal having a reduced content of sulfur, oxygen and nitrogen. Additionally, the solid material can be improved and used, for example, as defined and claimed in our co-pending application, entitled "Novel Fuel Compositions (Case B)", Ser. No. 865,607, filed concurrently herewith. At least a portion of the second liquid fraction is recycled to the first hydrogenation zone.

DESCRIPTION OF PREFERRED EMBODIMENTS

Figure 1:
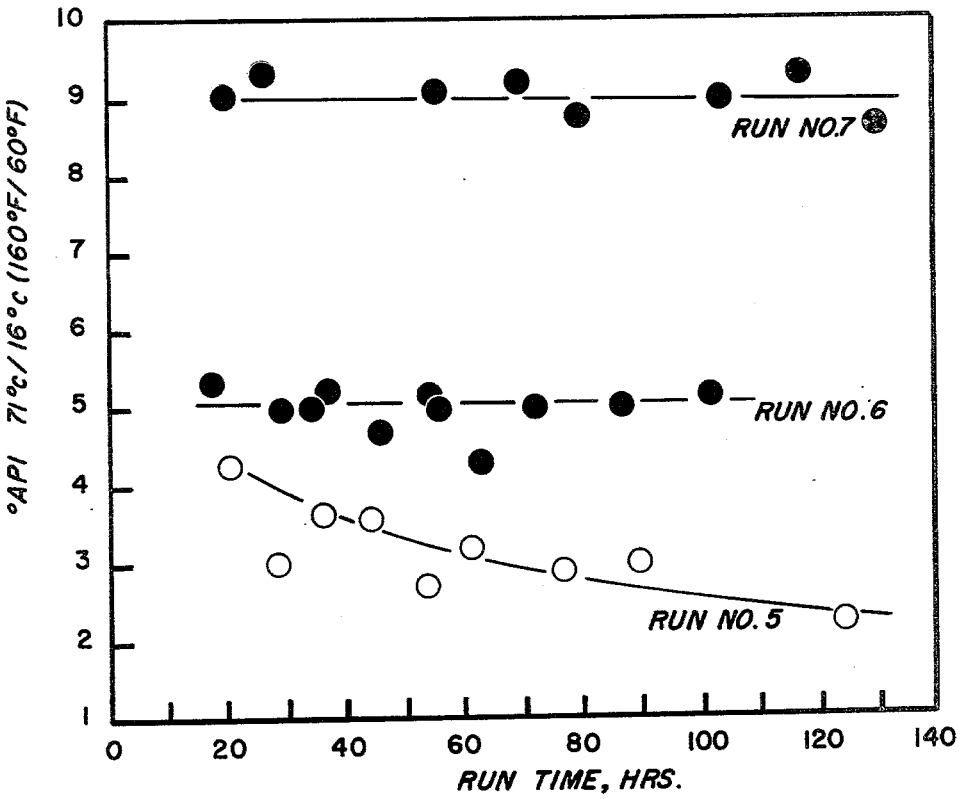

The invention will be further described with reference to the experimental data.

Activity and aging of the catalysts is indicated by °API for a given number of run hours in the examples which follow. °API is a gravity measurement (hygrometer method ASTM D-287) of the product and is a reasonable measure of catalyst activity, the amount of hydrogen taken-up in a given reaction. For example, product °API's of 0, +3 and +9 (from a −3°API feed) showed hydrogen consumptions of 2.6, 5.3 and 12 kmol $H_2/m^3$ feed, respectively. Variations between successive °API readings during the course of a run would then indicate the amount of catalyst aging. The °API measurements were typically made at 71° C./16° C. as compared to the more common 16° C./16° C. to make certain that the product would have a positive value rather than a negative °API value.

The catalysts employed in the experimental work were prepared by conventional methods. These methods do not constitute any part of the present invention.

Example 1: Forming an Intermediate Coal-Solvent Slurry

An intermediate coal-solvent slurry was prepared according to the process as described in U.S. Pat. No. 3,341,447 to Bull et al. An ash-containing coal from the Pittsburg and Midway Coal Company Colonial Mine was used in the experimental work. The coal had the following analysis:

Table 8

| Ash-Containing Coal Analysis (Dry Basis) | wt % |
|---|---|
| Carbon | 71.8 |
| Hydrogen | 5.0 |
| Nitrogen | 1.3 |
| Oxygen | 7.9 |
| Sulfur | 3.7 |
| Ash | 10.3 |

Two separate runs were carried out wherein ash-containing coal was dissolved under catalyst-free hydrogenation conditions in a solvent, substantially as described in Table 6, as "a second liquid fraction", recovered from previous extraction runs in accordance with the present invention under the conditions as set forth in Table 9.

Table 9

| Catalyst-Free Conditions | | |
|---|---|---|
| Run No. | 1 | 2 |
| Temperature, °C. | 450 | 460 |
| Pressure, kPa (psig) | 10,755 (1560) | 10,190 (1478) |
| Solvent/Coal Weight Ratio | 2.14/1 | 1.67/1 |
| Hydrogen/Coal Feed Weight Ratio | 0.08/1 | 0.08/1 |
| Residence Time, hrs | 1 | 1 |

Example 2: Deashing an Intermediate Coal-Solvent Slurry

Ash and/or other insolubles was separated from the intermediate coal-solvent slurry of the runs in Example 1 by filtration under the conditions as set forth in Table 10 to form a coal-solvent solution. An analysis of the coal-solvent solution is set forth in Table 11.

Table 10

| Filtration Conditions | | |
|---|---|---|
| Run No. | 3 | 4 |
| Feed | Product from Run 1 | Product from Run 2 |
| Filter Temperature, °C. | 229 | 254 |
| Filter Pressure, kPa (psig) | 1206 (175) | 1861 (270) |
| Pressure Drop, kPa (psig) | 207 (30) | 207 (30) |
| Knife Advance, mil/min | 1 | 1.5 |
| Drum Speed, min/revolution | 1.0–1.5 | 0.56 |
| Basecoat | Fibra F10-11C and Celite 545 | Fibra F10-11C and Celite 543 |
| Precoat | Celite 535 | Dicalite Speed-plug |

Table 11

| Coal-Solvent Solution Analysis | | |
|---|---|---|
| Run No. | 5 | 6 |
| | Product from Run 3 Wt. % | Product from Run 4 Wt. % |
| Carbon | 89.3 | 89.3 |
| Hydrogen | 6.3 | 6.3 |
| Nitrogen | 1.2 | 1.2 |
| Oxygen | 2.5 | 2.5 |
| Sulfur | 0.7 | 0.7 |
| Ash | 0.04 | 0.04 |
| °API at 71° C./16° C. | −3.0 | −5.0 |

It can be seen from the data of Table 11 that the analyses for each of the two runs were virtually identical due to the similarity in both the catalyst-free process and filtration.

Example 3: Separation Into Two Liquid Fractions and a Solid Fraction Before Catalytic Hydrogenation The coal-solvent solution from Run 3 was subjected to distillation to separate it into two liquid fractions and a solid before catalytic hydrogenation for comparison with an identical distillation after catalytic hydrogenation as in the present invention. A first liquid fraction was that fraction which boiled between about 191° to about 288° C. at ambient pressure in the separation by distillation. A second liquid fraction was that fraction which boiled between about 288 to about 454° C. at ambient pressure in the separation by distillation. On completion of the distillation of the two fractions, there remained a solid and/or semi-solid material. Elemental analyses of the two liquid fractions and the solid and/or semi-solid material are set forth in Table 12. A small amount of material, about 0 to about 5 percent, usually less than about 3 percent, boiling at a temperature lower than 191° C. can be obtained. The amount of such material depends on the process conditions.

Table 12

| Analyses of Liquid and Solid Fractions | | Wt. % |
|---|---|---|
| First Fraction (191°–228° C.) | Carbon | 87.6 |
| | Hydrogen | 8.0 |
| | Nitrogen | 0.7 |
| | Oxygen | 3.4 |
| | Sulfur | 0.3 |
| Second Fraction (288°–454° C.) | Carbon | 90.1 |
| | Hydrogen | 6.5 |
| | Nitrogen | 0.7 |
| | Oxygen | 1.7 |
| | Sulfur | 1.0 |
| Solid Material | Carbon | 87.8 |
| | Hydrogen | 5.6 |
| | Nitrogen | 2.0 |
| | Oxygen | 4.1 |
| | Sulfur | 0.8 |

Example 4: Catalytic Hydrogenation of Coal-Solvent Solution

Three runs were carried out wherein the coal solvent solutions of Run Nos. 3 and 4 were subjected to catalytic hydrogenation by passing the solutions over specific catalysts under specific reaction conditions as set forth in Table 13.

Table 13

| Catalyst Composition and Reaction Conditions | | | | | | |
|---|---|---|---|---|---|---|
| Run No. | Catalyst[1] | Feed Product of Run | Pressure, kPa (psig) | Liquid Hourly Space Velocity, ml feed/ml catalyst/hr | Hydrogen Flow Rate, kmol $H_2/m^3$ feed | Temperature °C. |
| 5 | 0.5 wt % nickel 1.0 wt % cobalt 8.0 wt % molybdenum | 4 | 13,788 (2,000) | 2.0 | 75.2 | 427 |
| 6 | 3.0 wt % nickel 5.0 wt % titanium 8.0 wt % molybdenum | 4 | 13,788 (2,000) | 2.0 | 75.2 | 427 |
| 7 | 3.0 wt % nickel 5.0 wt % titanium 8.0 wt % molybdenum | 3 | 20,682 (3,000) | 2.0 | 75.2 | 427 |

[1]The metals were deposited on alumina having a surface area of 185 $m^2/g$, a pore diameter of 188 A and a pore volume of 0.66 cc/gm.

The results of the catalytic hydrogenation are shown in FIG. 1. All runs have an increased amount of hydrogen incorporated as indicated by the higher °API values as compared to °API values in Table 11. In order of preference a nickel-titanium-molybdenum catalyst is more desirable than a nickel-cobalt-molybdenum catalyst, although both catalysts are acceptable in the present invention.

Example 5: Separation into First Liquid Fraction, Second Liquid Fraction and Solid Material After Catalytic Hydrogenation The product of Run No. 7 was subjected to separation by distillation after catalytic hydrogenation into (a) a first liquid fraction which boiled between about 191° to about 288° C., (b) a second liquid fraction that boiled between about 288° to about 386° C. and (c) a solid and/or semisolid material. An analysis of each of these is set forth in Table 14. A small amount of material, about 0 to about 5 percent, usually less than about 3 percent, boiling at a temperature lower than 191° C. can be obtained. The amount of such material depends on the process conditions.

Table 14

| Liquid Fraction and Solid and/or Semi-Solid Analyses | | Wt. % |
|---|---|---|
| First Liquid Fraction (191°–288° C.) | Carbon | 89.3 |
| | Hydrogen | 10.0 |
| | Nitrogen | 0.3 |
| | Oxygen | 0.4 |
| | Sulfur | <0.04 |
| Second Liquid Fraction (288°–386° C.) | Carbon | 90.7 |
| | Hydrogen | 8.5 |
| | Nitrogen | 0.4 |
| | Oxygen | 0.4 |
| | Sulfur | 0.05 |
| Solid and/or Semi-Solid Material | Carbon | 90.0 |
| | Hydrogen | 7.1 |
| | Nitrogen | 1.2 |
| | Oxygen | 0.3 |
| | Sulfur | 0.1 |

Comparing these values with the values from Table 12, it can be seen that a significant amount of hydrogen has been incorporated and nitrogen, sulfur and oxygen have been greatly reduced in all fractions. Thus the recycle fraction, i.e., the second liquid fraction herein, is of a significantly higher quality and is more suitable for use under catalyst-free hydrogenation conditions in a first hydrogenation zone. Most important, however, the solid material from Run No. 7 in Table 14 is much more suitable for use as a solid fuel for burning or for use as a blending component with other fractions as described in our co-pending application, entitled "Novel Fuel Compositions (Case B)," Ser. No. 865,607, filed concurrently herewith.

Example 6: NiCoMo-Containing Catalyst

Figure 2:
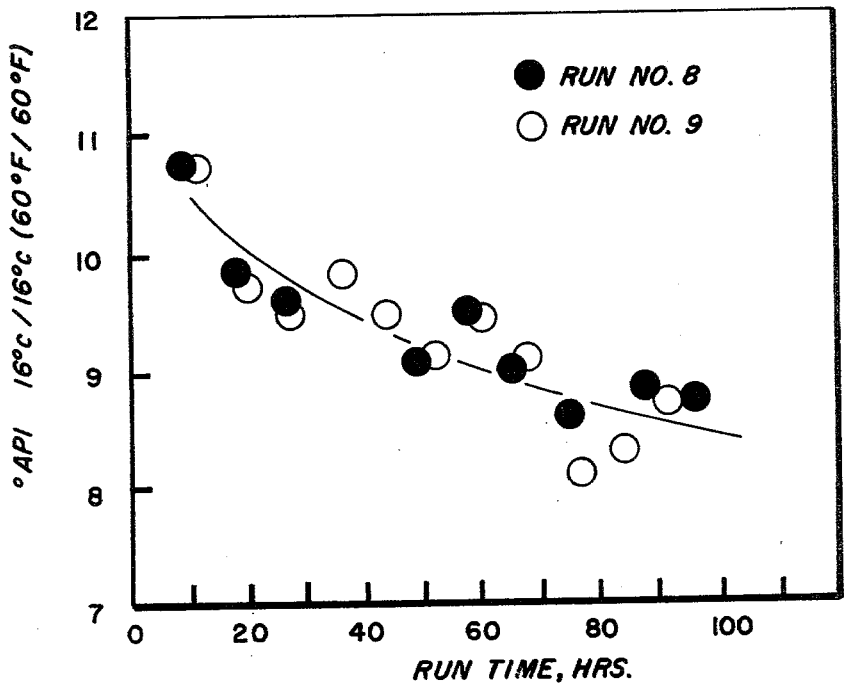

FIG. 1 also illustrated the superior aging characteristics of catalysts containing NiTiMo on alumina over catalysts containing NiCoMo on alumina. In examining the metal loading content of the two catalysts, on a molar basis, it was noted that the NiTiMo-containing catalyst has a higher metal loading content. To show that the NiCoMo-containing catalyst with the same metal loading content as the NiTiMo-containing catalyst produced a catalyst which did not age as well as the NiTiMo-containing catalyst, a catalyst containing 3.0 weight percent nickel, 6.0 weight percent cobalt and 8.0 weight percent molybdenum was perpared. This catalyst and the 0.5 weight percent nickel, 1.0 weight percent cobalt, and 8.0 weight percent molybdenum-containing catalyst were compared at equivalent conditions: 420° C. (800° F.), 13,788 kPa (2,000 psig), 2.0 LHSV, and 75.2 kmol $H_2/m^3$ feed using a feed similar to that described in the previous examples. The results are presented in FIG. 2 as Run Nos. 8 and 9. The °API values in FIG. 2 were taken at a lower temperature, since negative values were not expected. From FIG. 2 is can be seen that identical results were obtained. Thus, the metal loading content of the NiCoMo catalyst in the range studied has no effect on the aging of the catalyst.

Example 7: Effectiveness of NiW on Alumina Catalyst

While the above data demonstrate the use of both a NiCoMo-on-alumina and NiTiMo-on-alumina catalysts, other catalysts with different metal combinations are also applicable. A 6.0 weight percent nickel and 19.0 weight percent tungsten on alumina catalyst was also employed in the invention herein. Results with this catalyst using the same feed and processing conditions of Run 7 of Table 13 and FIG. 1 are set forth in Table 15.

Table 15

| Processing with a NiW on Alumina Catalyst | |
|---|---|
| Run Time, Hrs. | °API−71° C./16° C. (160° F./60° F.) |
| 16 | 7.0 |
| 31 | 6.4 |
| 47 | 7.3 |
| 63 | 7.0 |
| 93 | 7.0 |

This catalyst showed hydrogen incorporation as evident from an °API increase of from −3 for the feed and to 7 for the product. While the NiW catalyst did not age, it did not have as high an activity level as the NiCoMo- or NiTiMo-based catalyst.

Obviously, many modifications and variations of the invention, as hereinabove set forth, can be made without departing from the spirit and scope thereof, and, therefore, only such limitations should be imposed as are indicated in the appended claims.

We claim:

1. A process for producing an upgraded material which is solid and/or semi-solid at room temperature having a substantially lower ash, sulfur and nitrogen content from coal containing from about 0.1 to about 30 weight percent ash, from about 0.25 to about 2.5 weight percent nitrogen and from about 0.3 to about 10 weight percent sulfur consisting essentially in the steps of (1) subjecting a slurry composed of said coal containing ash, nitrogen and sulfur and a solvent containing donatable hydrogen, together with hydrogen, to substantially catalyst-free hydrogenation conditions in a first hydrogenation zone wherein the temperature is in the range of about 343° to about 510° C., the pressure is in the range of about 500 to about 5000 psig, the solvent to coal weight ratio is in the range of about 0.5/1 to about 10/1, the hydrogen/coal feed weight ratio is in the range of about 0.01 to about 0.30/1, the hydrogen gas purity is in the range of about 85 to about 100 mole percent and the residence time is in the range of about 0.1 to about 5.0 hours, to form an intermediate coal-solvent slurry; (2) deashing said intermediate coal-solvent slurry to form a coal-solvent solution, said coal-solvent solution being such that in the absence of solvent therein at ambient temperature and pressure left behind would be deashed coal; (3) subjecting said coal-solvent solution to catalytic hydrogenation in a second hydrogenation zone in the presence of a catalyst consisting essentially of nickel, titanium and molybdenum wherein the temperature is in the range of about 260° to about 538° C., the pressure is in the range of about 500 to about 10,000 psig, the liquid hourly space velocity is in the range of about 0.3 to about 10 volume feed/volume catalyst/hour and the hydrogen flow rate is in the range of about 25 to about 190 kmol $H_2/m^3$ feed to obtain a liquid product, (4) separating said liquid product to obtain (a) said desired upgraded material which is solid and/or semi-solid at room temperature having a substantially lower ash, sulfur and nitrogen content than the coal charge, (b) a first liquid fraction boiling at a temperature in the range of about 100° to about 375° C. and (c) a second liquid fraction boiling above said first liquid fraction at a temperature in the range of about 200° to about 525° C.; and then (5) recycling at least a portion of said second liquid fraction to said first hydrogenation zone.

2. The process of claim 1 wherein in said first hydrogenation zone the temperature is in the range of about 399° to about 482° C., the pressure is in the range of about 1000 to about 2000 psig, the solvent/coal weight ratio is in the range of about 1/1 to about 4/1, the hydrogen/coal feed weight ratio is in the range of about 0.05/1 to about 0.10/1, the hydrogen gas purity is in the range of about 95 to about 97 mole percent and the residence time is in the range of about 0.5 to about 2.0 hours and wherein in said second hydrogenation zone the temperature is in the range of about 399° to about 454° C., the pressure is in the range of about 1000 to about 4000 psig, the liquid space velocity is in the range of about 1.0 to about 4 volume feed/volume catalyst/hour and the hydrogen flow rate is in the range of about 60 to about 90 kmol $H_2/m^3$ feed.

3. The process of claim 1 wherein said coal being treated contains from about 0.5 to about 20 weight percent ash, from about 0.75 to about 2.5 weight percent nitrogen and from about 0.5 to about 6.0 weight percent sulfur.

4. The process of claim 1 wherein said first liquid fraction boils at a temperature in the range of about 150° to about 325° C. and said second liquid fraction boils at a temperature in the range of about 250° to about 475° C.

5. The process of claim 1 wherein said deashing is by filtration.

6. The process of claim 1 wherein the atomic ratio of nickel to molybdenum in the catalyst is in the range of about 1:0.3 to about 1:5.

7. The process of claim 1 wherein the atomic ratio of nickel to molybdenum in the catalyst is in the range of about 1:0.5 to about 1:3.5.

8. The process of claim 1 wherein the catalyst has a total molybhenum plus nickel metals content of about 5 to about 50 percent by weight based on the total catalyst.

9. The process of claim 1 wherein the catalyst has a total molybdenum plus nickel metals content of about 5 to about 30 percent by weight based on the total catalyst.

10. The process of claim 1 wherein the amount of titanium in the catalyst is in the range of about 1.0 to about 10 percent by weight based on the total catalyst.

11. The process of claim 1 wherein the amount of titanium in the catalyst is in the range of about 1.0 to about 8 percent by weight based on the total catalyst.

12. The process of claim 1 wherein a portion of said ash obtained from said intermediate coal solvent slurry in step 2 is recycled to said first hydrogenation zone.

* * * * *